US011820954B2

(12) United States Patent
Tamura

(10) Patent No.: US 11,820,954 B2
(45) Date of Patent: Nov. 21, 2023

(54) LUBRICANT COMPOSITION FOR TRANSMISSION, PRODUCTION METHOD THEREOF, LUBRICATING METHOD USING LUBRICANT COMPOSITION FOR TRANSMISSION, AND TRANSMISSION

(71) Applicant: IDEMITSU KOSAN CO., LTD., Chiyoda-ku (JP)

(72) Inventor: Kazushi Tamura, Kawasaki (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/601,800

(22) PCT Filed: Apr. 22, 2020

(86) PCT No.: PCT/JP2020/017378
§ 371 (c)(1),
(2) Date: Oct. 6, 2021

(87) PCT Pub. No.: WO2020/218367
PCT Pub. Date: Oct. 29, 2020

(65) Prior Publication Data

US 2022/0204883 A1 Jun. 30, 2022

(30) Foreign Application Priority Data

Apr. 26, 2019 (JP) ..... 2019-086169

(51) Int. Cl.

| | |
|---|---|
| ***C10M 143/04*** | (2006.01) |
| ***C10M 169/04*** | (2006.01) |
| ***C10M 101/00*** | (2006.01) |
| *C10N 40/04* | (2006.01) |
| *C10N 20/02* | (2006.01) |
| *C10N 20/04* | (2006.01) |
| *C10N 20/06* | (2006.01) |
| *C10N 30/02* | (2006.01) |

(52) U.S. Cl.
CPC ..... *C10M 143/04* (2013.01); *C10M 101/00* (2013.01); *C10M 169/041* (2013.01); *C10M 2203/1025* (2013.01); *C10M 2205/024* (2013.01); *C10N 2020/02* (2013.01); *C10N 2020/04* (2013.01); *C10N 2020/06* (2013.01); *C10N 2030/02* (2013.01); *C10N 2040/042* (2020.05); *C10N 2040/045* (2020.05)

(58) Field of Classification Search
CPC ..... C10M 143/04; C10M 169/041; C10N 2020/02; C10N 2020/04; C10N 2020/06; C10N 2030/02; C10N 2040/042; C10N 2040/045
See application file for complete search history.

(56) References Cited

U.S. PATENT DOCUMENTS

| | | | | |
|---|---|---|---|---|
| 5,217,636 | A * | 6/1993 | Paboucek | C10M 157/00 508/591 |
| 6,310,010 | B1 * | 10/2001 | Higton | C10M 163/00 508/296 |
| 2006/0049081 | A1 | 3/2006 | Tsubouchi et al. | |
| 2013/0029892 | A1 * | 1/2013 | Yamada | C10M 169/041 508/363 |
| 2014/0179578 | A1 | 6/2014 | Tsou et al. | |
| 2016/0369201 | A1 | 12/2016 | Kasai et al. | |
| 2017/0114166 | A1 * | 4/2017 | Harada | C08F 210/16 |
| 2017/0175029 | A1 | 6/2017 | Watanabe | |
| 2017/0253701 | A1 * | 9/2017 | Tsou | C08L 83/10 |
| 2020/0332216 | A1 | 10/2020 | Hamachi | |

FOREIGN PATENT DOCUMENTS

| | | | |
|---|---|---|---|
| CN | 106062156 | A | 10/2016 |
| CN | 108699487 | A | 10/2018 |
| EP | 2 053 117 | A1 | 4/2009 |
| JP | 2002-511519 | A | 4/2002 |
| JP | 2006-117851 | A | 5/2006 |
| JP | 2008-37963 | A | 2/2008 |
| JP | 2010-70591 | A | 4/2010 |
| JP | 2011-195734 | A | 10/2011 |
| JP | 2014-98090 | A | 5/2014 |
| JP | 2016-69405 | | 5/2016 |
| JP | 2016-69405 | A | 5/2016 |
| WO | WO 2004/026998 | A1 | 4/2004 |

(Continued)

OTHER PUBLICATIONS

Combined Chinese Office Action and Search Report dated Sep. 1, 2022 in Chinese Patent Application No. 202080030681.X, 10 pages.
International Search Report dated Jun. 30, 2020 in PCT/JP2020/017378 filed on April 22, 2020. 2 pages
Extended European Search Report dated Dec. 20, 2022 in European Patent Application No. 20793979.4, 7 pages.
Japanese Office Action dated Mar. 7, 2023 in Japanese Application No. 2019-086169 (with unedited computer-generated English translation), 5 pages.
Official Communication issued in Chinese patent application 202080030681.X dated Jul. 15, 2023 (with attached English Concise Explanation).
International Search Report dated Jun. 30, 2020 in PCT/JP2020/017378 filed on Apr. 22, 2020. 2 pages

*Primary Examiner* — Ellen M McAvoy
(74) *Attorney, Agent, or Firm* — Oblon, McClelland, Maier & Neustadt, L.L.P.

(57) ABSTRACT

Provided are: a lubricating oil composition for transmissions having a long fatigue life and a low viscosity, which contains a base oil and an olefin copolymer and in which the mass-average molecular weight of the olefin copolymer is 5,000 or more and 30,000 or less, the hydrodynamic radius of the olefin copolymer is 1.00 nm or more and 5.00 nm or less, and the content of the olefin copolymer based on the total amount of the composition is 1.0% by mass or more and 8.0% by mass or less; and a production method for the composition, a lubricating method using a lubricating oil composition for transmissions, and a transmission.

11 Claims, No Drawings

(56) References Cited

FOREIGN PATENT DOCUMENTS

| | | | |
|---|---|---|---|
| WO | WO 2015/147215 | A1 | 10/2015 |
| WO | WO 2015/152143 | A1 | 10/2015 |

* cited by examiner

LUBRICANT COMPOSITION FOR TRANSMISSION, PRODUCTION METHOD THEREOF, LUBRICATING METHOD USING LUBRICANT COMPOSITION FOR TRANSMISSION, AND TRANSMISSION

TECHNICAL FIELD

The present invention relates to a lubricating oil composition for transmissions, a production method for it, a lubricating method using a lubricating oil composition for transmissions, and a transmission.

BACKGROUND ART

From the viewpoint of environmental concerns that have become problematic these days, there is increasing a demand for further higher energy utilization efficiency for vehicles such as cars. One means for enhancing fuel efficiency is a method of reducing the viscosity of a lubricating oil composition for use for transmissions to thereby reduce the stirring resistance thereof.

Another method is a reduction in vehicle weight. Vehicle weight reduction, that is, vehicle downsizing brings about needs for downsizing of transmissions to be mounted on such vehicles, therefore resulting in lubricating area reduction, and if so, the lubricating oil composition for use for transmissions is required to satisfy severer performance such as fatigue life.

Fatigue life is a most important performance needed for a lubricating oil composition for use for transmissions. For improving fatigue life, a lubricating oil composition need to have an increased viscosity index and have stable viscosity characteristics. As a lubricating oil composition having such characteristics, there has been improved a lubricating oil composition using a polymethacrylate (PMA) as a viscosity index improver (for example, see PTL 1). Also there has been improved a lubricating oil composition containing a lubricant base oil having a predetermined 100° C. kinematic viscosity and an ethylene-α-olefin copolymer (see PTL 2).

CITATION LIST

Patent Literature

PTL 1: JP 2006-117851A
PTL 2: JP 2008-037963A

SUMMARY OF INVENTION

Technical Problem

Regarding viscosity reduction referred to as one means for enhancing fuel efficiency, in general, when the viscosity of a lubricating oil is reduced, then the viscosity thereof may further reduce in a high-temperature range and therefore the oil film forming performance of the lubricating oil in the case greatly lowers. As a result, there may occur metal fatigue in the slide members of transmissions using such a lubricating oil to cause reduction in the fatigue life to often lower the durability of transmissions. Accordingly, it may be said that improvement of fatigue life and increase in fuel efficiency owing to viscosity reduction would be conflicting performances.

Of the lubricating oil composition described in PTL 1, the viscosity index can improve but the oil forming performance thereof lowers especially in use at high temperatures, and owing to the property of polymethacrylate (PMA) whose viscosity increase is remarkable at low temperatures, there may occur some problems that fatigue life lowers or fuel efficiency could not sufficiently increase. In the lubricating oil composition described in PTL 2, an ethylene-α-olefin copolymer having a molecular weight falling within a specific range is used in a predetermined ratio to attain certain effects in point of viscosity reduction and fatigue life, but there is room for further improvement in viscosity reduction and fatigue life.

Given the situation, the present invention addresses a problem of providing a lubricating oil composition for transmissions having a long fatigue life and having a low viscosity, and a method for producing it, and providing a lubricating method using the lubricating oil composition for transmissions, and a transmission.

Solution to Problem

The present inventors have made assiduous studies in consideration of the above-mentioned problem, and as a result, have found that the problem can be solved by the invention described below. Specifically, the present invention provides a lubricating oil composition for transmissions having the following constitution, a method for producing it, a lubricating method using the lubricating oil composition for transmissions, and a transmission.

1. A lubricating oil composition for transmissions, containing a base oil and an olefin copolymer, in which the mass-average molecular weight of the olefin copolymer is 5,000 or more and 30,000 or less, the hydrodynamic radius of the olefin copolymer is 1.00 nm or more and 5.00 nm or less, and a content of the olefin copolymer based on the total amount of the composition is 1.0% by mass or more and 8.0% by mass or less.

2. The lubricating oil composition for transmissions according to the above 1, satisfying the following numerical formula (1):

$$25.00 \leq -23.00 \times Rh^2 + 139.00 \times Rh + 4.75 \times C - 179.88 \quad (1)$$

wherein:

Rh is a hydrodynamic radius of the olefin copolymer (nm),

C is a content of the olefin copolymer based on the total amount of the composition (% by mass).

3. The lubricating oil composition for transmissions according to the above 1 or 2, wherein the hydrodynamic radius of the olefin copolymer is 2.00 nm or more and 4.00 nm or less.

4. The lubricating oil composition for transmissions according to any one of the above 1 to 3, wherein the 100° C. kinematic viscosity of the base oil is 1.0 $mm^2/s$ or more and 15.0 $mm^2/s$ or less.

5. The lubricating oil composition for transmissions according to any one of the above 1 to 4, wherein the base oil is a mineral oil.

6. The lubricating oil composition for transmissions according to any one of the above 1 to 5, having a 100° C. kinematic viscosity of 10.0 $mm^2/s$ or less.

7. The lubricating oil composition for transmissions according to any one of the above 1 to 6, which is for automatic transmissions, or for continuously variable transmissions.

8. A method for producing a lubricating oil composition for transmissions, including blending a base oil and an olefin copolymer having a mass-average molecular weight of 5,000 or more and 30,000 or less and having a hydrodynamic radius of 1.00 nm or more and 5.00 nm or less, in such a manner that the content (C) of the olefin copolymer based on the total amount of the composition can be 1.0% by mass or more and 8.0% by mass or less.

9. The method for producing a lubricating oil composition for transmissions according to the above 8, wherein the components are blended so as to satisfy the following numerical formula (1):

$$25.00 \leq -23.00 \times Rh^2 + 139.00 \times Rh + 4.75 \times C - 179.88 \quad (1)$$

wherein:

Rh is a hydrodynamic radius of the olefin copolymer (nm),

C is a content of the olefin copolymer based on the total amount of the composition (% by mass).

10. A lubricating method using a lubricating oil composition for transmissions of any one of the above 1 to 7.

11. A transmission using a lubricating oil composition for transmissions of any one of the above 1 to 7.

Advantageous Effects of Invention

The present invention can provide a lubricating oil composition for transmissions having a long fatigue life and having a low viscosity, and a method for producing it, and can provide a lubricating method using the lubricating oil composition for transmissions, and a transmission.

DESCRIPTION OF EMBODIMENTS

Hereinafter, embodiments of the present invention (hereinafter, also referred to as "the present embodiment") will be described. In this description, numerical values of "or more" and "or less" relating to the description of a numerical range are numerical values that can be combined in any desired manner, and the numerical values in Examples are numerical values that can be used as an upper limit or a lower limit of numerical ranges.

[Lubricating oil composition for transmission]

The lubricating oil composition for transmissions of the present embodiment contains a base oil and an olefin copolymer, wherein the mass-average molecular weight of the olefin copolymer is 5,000 or more and 30,000 or less, the hydrodynamic radius of the olefin copolymer is 1.00 nm or more and 5.00 nm or less, and the content of the olefin copolymer based on the total amount of the composition is 1.0% by mass or more and 8.0% by mass or less.

(Base Oil)

The base oil may be a mineral oil or a synthetic oil, a mixed oil of a mineral oil and a synthetic oil may also be used.

Examples of the mineral oil include atmospheric residues obtained through atmospheric distillation of crude oils such as paraffin base crude oils, intermediate base crude oils and naphthene base crude oils; distillates obtained through reduced-pressure distillation of such atmospheric residues; mineral oils obtained by purifying the distillates through one or more purification treatments of solvent deasphalting, solvent extraction, hydrocracking, solvent dewaxing, catalytic dewaxing or hydrorefining.

As the mineral oil, those grouped in Groups 2 and 3 in the base oil category by API (American Petroleum Institute) are preferred from the viewpoint of realizing a low friction coefficient and improving copper corrosion resistance.

Examples of the synthetic oil include poly-α-olefins such as polybutene, ethylene-α-olefin copolymers, α-olefin homopolymers or copolymers; various ester oils such as polyol esters, dibasic acid esters and phosphate esters; various ethers such as polyphenyl ethers; polyglycols; alkylbenzenes; alkylnaphthalenes; and GTL base oils obtained by isomerization of a wax produced from a natural gas through Fischer-Tropsch synthesis (GTL wax (Gas To Liquids WAX)).

For the base oil, one alone of the above-mentioned mineral oils and synthetic oils may be used, or plural kinds of mineral oils may be used as combined, or plural kinds of synthetic oils may be used as combined, or a mineral oil and a synthetic oil may be used as combined.

The viscosity of the base oil is not specifically limited, but the 40° C. kinematic viscosity thereof is preferably 3.0 $mm^2/s$ or more, more preferably 5.0 $mm^2/s$ or more, even more preferably 7.0 $mm^2/s$ or more, and the upper limit is preferably 50.0 $mm^2/s$ or less, more preferably 30.0 $mm^2/s$ or less, even more preferably 15.0 $mm^2/s$ or less.

The 100° C. kinematic viscosity of the base oil is preferably 1.0 $mm^2/s$ or more, more preferably 1.5 $mm^2/s$ or more, even more preferably 2.0 $mm^2/s$ or more, and the upper limit is preferably 15.0 $mm^2/s$ or less, more preferably 10.0 $mm^2/s$ or less, even more preferably 5.0 $mm^2/s$ or less.

The viscosity index of the base oil is preferably 85 or more, more preferably 90 or more, even more preferably 100 or more. In this description, the kinematic viscosity and the viscosity index are values measured using a glass capillary viscometer according to JIS K 2283:2000. When the kinematic viscosity and the viscosity index of the base oil are within the above ranges, the lubricating oil composition for transmissions can be made to have a low viscosity, and the fatigue life thereof can be prolonged more with ease, that is, the fatigue life thereof can be readily improved. (Hereinafter in this description, a technique of prolonging fatigue life may be referred to as "improvement of fatigue life" or "attempt at improvement of fatigue life".)

The content of the base oil based on the total amount of the composition is preferably 70.0% by mass or more, more preferably 75.0% by mass or more, even more preferably 80.0% by mass or more, and the upper limit is preferably 99.0% by mass or less, more preferably 95.0% by mass or less, even more preferably 90.0% by mass or less. When the content of the base oil is controlled to fall within the above range, the content of the olefin copolymer to be mentioned hereinunder can be secured and the addition effect of the polymer can be sufficiently attained.

(Olefin Copolymer)

The lubricating oil composition for transmissions of the present embodiment contains an olefin copolymer (hereinafter this may be referred to as ("OCP") that has a mass-average molecular weight of 5,000 or more and 30,000 or less and has a hydrodynamic radius (Rh) of 1.00 nm or more and 5.00 nm or less, in an amount of 1.0% by mass or more and 8.0% by mass or less based on the total amount of the composition. It is generally known that OCP having a smaller mass-average molecular weight tends to have a lower viscosity, while that having a larger one tends to have a higher viscosity. In the present embodiment, in consideration of the hydrodynamic radius (Rh) to be an index of frictional resistance that OCP in the lubricating oil composition receives, in addition to the concept of the mass-average molecular weight, an olefin copolymer falling within a predetermined range is used to make it possible to satisfy the two contradictory performances of fatigue life improvement and viscosity reduction both on a higher level.

Although the mechanism of satisfying both fatigue life improvement and viscosity reduction is not fully reliable, it may be considered that, using OCP having a predetermined mass-average molecular weight and a predetermined hydrodynamic radius, the coating condition (oil film forming condition) of the lubricating oil composition over the metal surface of a transmission of to be lubricated, especially over the metal surface thereof having fine irregularities can be improved while the viscosity of the composition as a whole is lowered, and therefore metal-to-metal shock can be thereby relaxed.

When the mass-average molecular weight of OCP is less than 5,000, it may be advantageous for viscosity reduction but sufficient oil film formability could not be attained, while on the contrary, when more than 30,000, viscosity reduction could not be attained and, in addition, the molecule of OCP may be too large so that OCP could be hardly in contact with the surface of metal, especially fine irregularities of the surface and, if so, a sufficient oil film could not be formed on the surface of metal. On the other hand, when the hydrodynamic radius (Rh) of OCP is less than 1.00 nm, the frictional resistance to be received from the lubricating oil composition itself may be too small so that the contact time between OCP and the subject to be lubricated would be insufficient and an oil film is therefore hardly formed. On the other hand, when more than 5.00 nm, the frictional resistance to be received from the lubricating oil composition itself may be too large so that the contact itself with the subject to be lubricated could not be attained, and an oil film is therefore hardly formed and viscosity reduction is also difficult. Accordingly, it is considered that, using an olefin copolymer having a predetermined mass-average molecular weight and a predetermined hydrodynamic radius, a lubricating oil composition capable of securing oil film formability and improving fatigue life and viscosity reduction can be provided here.

The mass-average molecular weight of the olefin copolymer is 5,000 or more and 30,000 or less. From the viewpoint of fatigue life improvement and viscosity reduction, the mass-average molecular weight of OCP is preferably 7,500 or more, more preferably 8,500 or more, even more preferably 9,500 or more, and the upper limit is preferably 25,000 or less, more preferably 20,000 or less, even more preferably 17,500 or less, further more preferably 16,000 or less.

In this description, the weight-average molecular weight of OCP is a polystyrene-equivalent mass-average molecular weight measured through gel permeation chromatography (GPC).

The hydrodynamic radius (Rh) of the olefin copolymer is 1.00 nm or more and 5.00 nm or less. From the viewpoint of fatigue life improvement and viscosity reduction, the hydrodynamic radius (Rh) of OCP is preferably 1.50 nm or more, more preferably 1.75 nm or more, even more preferably 2.00 nm or more, and the upper limit is preferably 4.80 nm or less, more preferably 4.50 nm or less, even more preferably 4.00 nm or less.

In this description, the hydrodynamic radius (Rh) of OCP is numerical value measured according to the following method.

A mineral oil or a synthetic oil for use as the base oil is used as a solvent, and the viscosity of the solvent, or the viscosity of solutions prepared by dissolving OCP in at least three arbitrary different kinds of content (g/l) are measured. The viscosity of the solvent is referred to as "$\eta_s$", and the viscosity of the solution is as "$\eta$". A specific viscosity $\eta_{sp}$ ($=(\eta-\eta_s)/\eta_s$) is calculated, and using this, the viscosity increase per the unit concentration of OCP (reduced viscosity) $\eta_{sp}/C$ (l/g, in which "C" is a mass concentration of OCP) is determined. Further using the mass concentration C of OCP, a Huggins plot is drawn, and the intrinsic viscosity [$\eta$] is determined. With the resultant intrinsic viscosity [$\eta$], a hydrodynamic volume ($V_H$) is calculated according to the Stokes-Einstein relation ($[\eta]=2.5\times N_A\times V_H/M$, in which $N_A$ is an Avogadro constant, M is a mass-average molecular weight of OCP, and $V_H$ is a hydrodynamic volume). A radius of the corresponding sphere with the hydrodynamic volume is referred to as the hydrodynamic radius (Rh).

Examples of the olefin copolymer include a copolymer of ethylene and an α-olefin, and a copolymer of styrene and a diene.

The α-olefin preferably has 3 or more carbon atoms, and the upper limit of the carbon number is preferably 30 or less, more preferably 20 or less, even more preferably 10 or less. More specifically, the α-olefin includes propylene, 1-butene, 1-pentene, 4-methyl-1-pentene, 1-hexane, 1-heptene, 1-octene, 1-nonene, and 1-decene. Above all, from the viewpoint of fatigue life improvement and viscosity reduction, and in consideration of easy availability, propylene and 1-butene are preferred as the α-olefin.

The diene includes isoprene and butadiene.

The content of the olefin copolymer based on the total amount of the composition is 1.0% by mass or more and 8.0% by mass or less. When the content is less than 1.0% by mass, the fatigue life improving effect of an effect of the olefin copolymer could not be sufficiently attained, but on the other hand, when more than 8.0% by mass, low fuel consumption could not be secured. From the viewpoint of fatigue life improvement and viscosity reduction, the content of OCP based on the total amount of the composition is preferably 1.25% by mass or more, more preferably 1.5% by mass or more, even more preferably 1.9% by mass or more, further more preferably 2.5% by mass or more, and the upper limit is preferably 6.5% by mass or less, more preferably 5.0% by mass or less, even more preferably 4.5% by mass or less.

(Other Additives)

The lubricating oil composition for transmissions of the present embodiment may be a composition composed of the above-mentioned base oil and olefin copolymer alone, or may optionally contain any other additives not corresponding to the above-mentioned component within a range not detracting from the advantageous effects of the present invention, such as an antioxidant, an extreme-pressure agent, a friction modifier, a corrosion inhibitor, a detergent, a dispersant, a pour point depressant, and an antifoaming agent. One alone or plural kinds of these additives may be used either singly or as combined.

The content of each other additive may be appropriately controlled within a range not detracting from the advantageous effects of the invention, and may be, based on the total amount of the lubricating oil composition, generally 0.1 to 15% by mass, preferably 0.5 to 10% by mass, more preferably 1.0 to 8% by mass.

The total content of the other additives is, based on the total amount of the lubricating oil composition, preferably 25% by mass or less, more preferably 20% by mass or less, even more preferably 15% by mass or less.

Examples of the antioxidant include monoalkyldiphenylamines having an alkyl group having approximately 3 to 10 carbon atoms, such as mono-t-butyldiphenylamine; dialkyldiphenylamines in which each alkyl group has approximately 3 to 10 carbon atoms, such as 4,4'-dibutyldiphenylamine; polyalkyldiphenylamines having 3 or more alkyl groups, in which each alkyl group has approximately 1 to 10 carbon atoms, such as tetrabutyldiphenylamine; phenyl-α-naphthylamines such as alkyl-substituted phenyl-α-naphthylamines having at least one alkyl group having approximately 1 to 12 carbon atoms, such as methylphenyl-α-naphthylamine, and phenyl-α-naphthylamines; amine-based antioxidants, such as monohindered amine-based antioxidants such as 2,2,6,6-tetramethylpiperidinyl methacrylate; and phenol-based antioxidants such as bisphenol-based antioxidants, such as 4,4'-methylenebis(2,6-di-t-butylphenol)bis(3-methyl-4-hydroxy-5-t-butylbenzyl) sulfide, and phenol-based antioxidants, such as monophenol-based antioxidants such as 2,6-di-t-butyl-4-methylphenol, and n-octadecyl-3-(4-hydroxy-3,5-di-t-butylphenyl) propionate.

Examples of the extreme-pressure agent include sulfur-based extreme-pressure agents such as olefin sulfides, hydrocarbyl sulfides, sulfurized fat or sulfurized oils, sulfurized fatty acids and sulfurized esters; phosphorus-based extreme-pressure agents, such as sulfuric acid ester compounds such as phosphates, acid phosphates, phosphites and hydrogen phosphites, and amine salts of such phosphoric acid ester compounds; and extreme-pressure agents containing a sulfur atom and a phosphorus atom, such as monothiophosphates, dithiophosphates, trithiophosphates, amine salts of monothiophosphates, amine bases of dithiophosphates, monothiophosphites, dithiophosphites, and trithiophosphites.

Examples of the friction modifier include ash-free friction modifiers such as aliphatic amines, fatty acid esters, fatty acid amides, fatty acids, aliphatic alcohols or aliphatic esters having at least one alkyl or alkenyl group having 6 to 30 carbon atoms in the molecule.

Examples of the corrosion inhibitor includes benzotriazole compounds, tolyltriazole compounds, imidazole compounds and pyrimidine compounds.

Examples of the detergent include metal-based detergents such as sodium, calcium or magnesium salicylates, sulfonates or phenates.

The dispersant includes ash-free dispersants such as boron-free succinimides, boron-containing succinimides, benzylamines, boron-containing benzylamines, succinates, and mono or dicarboxylic acid amides of typically fatty acids or succinic acid.

Examples of the pour point depressant include ethylene-vinyl acetate copolymers, condensates of chloroparaffin and naphthalene, condensates of chloroparaffin and phenol, polymethacrylates, and polyalkylstyrenes.

Examples of the anti-foaming agent include silicone-based anti-foaming agents such as silicone oil and fluorosilicone oil; and fluorine-based anti-foaming agents such as fluoroalkyl ethers.

(Property of Lubricating Oil Composition)

The lubricating oil composition for transmissions of the present embodiment preferably satisfies the following numerical formula (1):

$$25.00 \leq -23.00 \times Rh^2 + 139.00 \times Rh + 4.75 \times C - 179.88 \quad (1)$$

wherein:

Rh is a hydrodynamic radius of the olefin copolymer (nm),

C is a content of the olefin copolymer based on the total amount of the composition (% by mass).

In the numerical formula (1), when the numerical value calculated from the hydrodynamic radius and the content of the olefin copolymer "$-23.00 \times Rh^2 + 139.00 \times Rh + 4.75 \times C - 179.88$" (hereinafter this may be referred to as "x") is 25.00 or more, the lubricating oil composition can have a more improved fatigue life and a lower viscosity. Specifically, in the present embodiment, based on the presumption that the hydrodynamic radius and the content of OCP are so controlled that the hydrodynamic radius falls within a range of 1.00 nm or more and 5.00 nm or less and the content within a range of 1.0% by mass or more and 8.0% by mass or less, when x is controlled to be 25.00 or more, fatigue life improvement and viscosity reduction can be attained. x to be calculated according to the numerical formula (1) can be a numerical value close to the measured value of fatigue life (within ±20%), and therefore, for example, when the kind of OCP to be used and the content thereof are selected in order to obtain a lubricating oil composition having a desired fatigue life, it is possible to take x that has been previously calculated from the numerical formula (1) as a fatigue life (estimated value) and to utilize it as an index for obtaining a desired fatigue life.

In the present embodiment, the value of x is preferably 27.50 or more, more preferably 30.00 or more, even more preferably 35.00 or more, further more preferably 40.00 or more. Specifically, in the present embodiment, the hydrodynamic radius and the content of OCP are preferably so selected that the value of x can be 27.50 or more, more preferably 30.00 or more, even more preferably 35.00 or more, further more preferably 40.00 or more. When the hydrodynamic radius and the content of OCP each are controlled to fall within the above-mentioned preferred range, the value of x can be readily made to fall within the above-mentioned range.

The 100° C. kinematic viscosity of the lubricating oil composition for transmissions of the present embodiment is preferably 2.0 $mm^2/s$ or more, more preferably 2.5 $mm^2/s$ or more, even more preferably 3.5 $mm^2/s$ or more, and the upper limit is preferably 10.0 $mm^2/s$ or less, more preferably 7.5 $mm^2/s$ or less, even more preferably 5.0 $mm^2/s$ or less, further more preferably 4.5 $mm^2/s$ or less.

(Use of Lubricating Oil Composition)

The lubricating oil composition of the present embodiment is for transmissions, and is, for example, favorably used for manual transmissions, automatic transmissions or continuously variable transmissions that are for use for automobiles, precisely for automatic transmissions having a lockup clutch, and other various types of transmissions such as metal belt-type, chain-type or toroidal-type, continuously variable transmissions. From the viewpoint of effectively utilizing the characteristics of long fatigue life and low viscosity of the lubricating oil composition for transmissions of the present embodiment, the composition is favorably used for any of automatic transmissions or continuously variable transmissions among the above.

[Production Method for Lubricating Oil Composition for Transmissions]

A method for producing the lubricating oil composition for transmissions of the present embodiment includes blending a base oil and an olefin copolymer having a mass-average molecular weight of 5,000 or more and 30,000 or less and having a hydrodynamic radius of 1.00 nm or more and 5.00 nm or less, in such a manner that the content (C) of the olefin copolymer based on the total amount of the composition can be 1.0% by mass or more and 8.0% by mass or less.

In the production method for producing the lubricating oil composition for drive-system instruments of the present embodiment, the base oil, the olefin copolymer, the blending amount thereof, the other component and the blending amount thereof, and the other details are the same as those in the preferred embodiments of the lubricating oil composition for transmissions of the present embodiment described previously hereinabove. Also the preferred embodiment of satisfying the above numerical formula (1) is the same as previously.

The order of blending the components is not specifically limited, and for example, an olefin copolymer may be blended in a base oil, and in the case where other additives are used, an olefin copolymer and other additives may be blended sequentially in a base oil, or a mixture previously prepared by blending an olefin copolymer with other additives may be blended in a base oil.

[Lubricating Method and Transmission]

The lubricating method of the present embodiment is characterized by using the lubricating oil composition for transmissions of the present embodiment. Namely, the method is a lubricating method for transmissions characterized by using the lubricating oil composition for transmissions of the present embodiment.

Preferred examples of the transmission include various types of transmissions for use in automobiles, such as manual transmissions, automatic transmissions and continuously variable transmissions. The lubricating oil composition for transmissions of the present embodiment has a long life time and a low viscosity, and therefore can also be used, for example, for industrial-use gears to attain the same effect as in use in transmissions.

The transmission of the present embodiment is characterized by using the lubricating oil composition for transmissions of the present embodiment. Examples of the transmission are the same as those exemplified hereinabove that are applicable to the lubrication method for transmissions described previously hereinabove.

EXAMPLES

Next, the present invention is described in more detail with reference to Examples, but the present invention is not limited at all by these Examples.

The components constituting the lubricating oil compositions of Examples and Comparative Examples are mentioned below, and various physical data of the lubricating oil compositions of Examples and Comparative Examples were measured according to the methods mentioned below.

(Kinematic Viscosity and Viscosity Index)

Measured according to JIS K2283:2000.

(Mass-Average Molecular Weight)

The mass-average molecular weight (Mw) is a polystyrene-equivalent mass-average molecular weight measured through gel permeation chromatography (GPC), and is a value measured under the following condition and obtained with polystyrene as a calibration curve.

Apparatus: "1260 Infinity" (trade name, by Agilent Technologies Corporation)

Column: "GPC LF404" (trade name, by Shodex Corporation)□2

Solvent: chloroform

Temperature: 40° C.

Sample concentration: 0.5% by mass

Calibration curve: polystyrene

Detector: differential refractive index detector (Calculation of Hydrodynamic Radius)

A solution was prepared by dissolving the polymer used in Examples and Comparative Examples in a base oil A (mentioned below), and the viscosity of the solvent and that of the solution were measured, which were referred to as "$\eta_s$" and "$\eta$", respectively. A specific viscosity $\eta_{sp}$ (=$(\eta-\eta_s)/\eta_s$) was calculated, and using this, the viscosity increase per the unit concentration of OCP (reduced viscosity) $\eta_{sp}/C$ (l/g, in which "C" is a mass concentration of OCP) was determined. Further using the mass concentration C of OCP, a Huggins plot was drawn, and the intrinsic viscosity [η] was determined. With the resultant intrinsic viscosity [η], a hydrodynamic volume ($V_H$) was calculated according to the Stokes-Einstein relation ($[\eta]=2.5\times N_A\times V_H/M$, in which $N_A$ is an Avogadro constant, M is a mass-average molecular weight of OCP, and $V_H$ is a hydrodynamic volume). A radius of the corresponding sphere with the hydrodynamic volume was referred to as the hydrodynamic radius (Rh).

(Measurement of Fatigue Life)

Using a four-ball rolling fatigue tester, the fatigue life of the lubricating oil composition of Examples and Comparative Examples was measured as stated below.

| (Bearing) | |
|---|---|
| Material: | bearing steel |
| Test piece: | ϕ60 × thickness 5 mm |
| Size of test steel ball: | ϕ⅜ inch (⅜ × 2.54 cm) |
| (Test Condition) | |
| Load: | 147N |
| Rotation speed: | 2200 rpm |
| Oil temperature: | 120° C. |

The time until the test piece has gotten flaking is referred to as fatigue life. From the results of six tests, L50 (average value) is calculated.

Examples 1 to 5, Comparative Examples 1 to 5

According to the compositional ratio shown in Table 1, lubricating oil compositions of Examples and Comparative Examples were prepared, and the properties thereof were measured according to the above-mentioned methods. The measurement results are shown in Table 1.

TABLE 1

| | | | Example | | | | |
|---|---|---|---|---|---|---|---|
| | | | 1 | 2 | 3 | 4 | 5 |
| Formulation | Base Oil A | mass % | — | — | — | 84.00 | 85.00 |
| | Base Oil B | mass % | 85.00 | 86.00 | 86.25 | — | — |
| | OCP | mass % | 3.00 | 2.00 | 1.75 | 4.00 | 3.00 |
| | PMA | mass % | — | — | — | — | — |
| | Additive | mass % | 12.00 | 12.00 | 12.00 | 12.00 | 12.00 |
| | Total | mass % | 100.00 | 100.00 | 100.00 | 100.00 | 100.00 |

TABLE 1-continued

| | | | | | | | |
|---|---|---|---|---|---|---|---|
| Polymer Properties | OCP Properties | | | | | | |
| | mass-average molecular weight | — | 10,000 | 15,000 | 17,000 | 10,000 | 15,000 |
| | 100° C. kinematic viscosity | $mm^2/s$ | 2.8 | 2.8 | 2.8 | 2.1 | 2.1 |
| | hydrodynamic radius (Rh) | nm | 2.62 | 3.29 | 3.69 | 2.62 | 3.29 |
| | PMA Properties | | | | | | |
| | mass-average molecular weight | — | — | — | — | — | — |
| | 100° C. kinematic viscosity | $mm^2/s$ | — | — | — | — | — |
| | hydrodynamic radius (Rh) | nm | — | — | — | — | — |
| Properties | 100° C. kinematic viscosity of base oil | $mm^2/s$ | 2.8 | 2.8 | 2.8 | 2.2 | 2.2 |
| | 100° C. kinematic viscosity of composition | $mm^2/s$ | 4.2 | 4.2 | 4.2 | 4.2 | 4.2 |
| Evaluation | Fatigue Life (expected)*[1] | hr | 40.67 | 37.98 | 28.17 | 45.42 | 42.73 |
| | Fatigue Life (found) | hr | 41.40 | 35.30 | 33.40 | 51.70 | 35.10 |
| | Found/Expected | % | 101.8 | 93.0 | 118.6 | 113.8 | 82.2 |

| | | | Comparative Example | | | | |
|---|---|---|---|---|---|---|---|
| | | | 1 | 2 | 3 | 4 | 5 |
| Formulation | Base Oil A | mass % | — | 81.00 | — | 81.71 | 83.42 |
| | Base Oil B | mass % | 82.75 | — | 84.28 | — | — |
| | OCP | mass % | 5.25 | 7.00 | — | — | — |
| | PMA | mass % | — | — | 3.72 | 6.29 | 4.58 |
| | Additive | mass % | 12.00 | 12.00 | 12.00 | 12.00 | 12.00 |
| | Total | mass % | 100.00 | 100.00 | 100.00 | 100.00 | 100.00 |
| Polymer Properties | OCP Properties | | | | | | |
| | mass-average molecular weight | — | 4,800 | 4,800 | — | — | — |
| | 100° C. kinematic viscosity | $mm^2/s$ | 2.8 | 2.1 | — | — | — |
| | hydrodynamic radius (Rh) | nm | 1.68 | 1.68 | — | — | — |
| | PMA Properties | | | | | | |
| | mass-average molecular weight | — | — | — | 31,000 | 9,500 | 31,000 |
| | 100° C. kinematic viscosity | $mm^2/s$ | — | — | 2.8 | 2.1 | 2.1 |
| | hydrodynamic radius (Rh) | nm | — | — | 3.27 | 2.05 | 3.27 |
| Properties | 100° C. kinematic viscosity of base oil | $mm^2/s$ | 2.8 | 2.2 | 2.8 | 2.2 | 2.2 |
| | 100° C. kinematic viscosity of composition | $mm^2/s$ | 4.2 | 4.2 | 4.2 | 4.2 | 4.2 |
| Evaluation | Fatigue Life (expected)*[1] | hr | 13.66 | 21.97 | 46.38 | 38.29 | 50.47 |
| | Fatigue Life (found) | hr | 11.60 | 22.60 | 24.30 | 20.40 | 26.50 |
| | Found/Expected | % | 84.9 | 102.8 | 52.4 | 53.3 | 52.5 |

*[1]Fatigue life (expected) is a value calculated according to the numerical formula (1).

Details of the components in the above Table are as follows.

Base oil A: paraffin-base mineral oil (40° C. kinematic viscosity: 7.1 $mm^2/s$, 100° C. kinematic viscosity: 2.2 $mm^2/s$, viscosity index: 109)

Base oil B: paraffin-base mineral oil (40° C. kinematic viscosity: 10.1 $mm^2/s$, 100° C. kinematic viscosity: 2.8 $mm^2/s$, viscosity index: 113)

OCP: olefin copolymer (ethylene-propylene copolymer)

PMA: polyalkyl methacrylate

Additive: ATF additive package (antioxidant, extreme-pressure agent, friction modifier, metal-based detergent, ash-free dispersant, pour point depressant, silicone-based anti-foaming agent)

From the results in Table 1, it was confirmed that the lubricating oil compositions for transmissions of the present embodiment have a long fatigue life and a low viscosity. Also it was confirmed that the fatigue life (calculated value) calculated according to the numerical formula (1) falls within a range of ±20% of the found value of the fatigue life, and therefore the calculated value could be said to be a numerical value that could be utilized as an index of fatigue life.

On the other hand, the lubricating oil compositions of Comparative Examples 1 and 2, in which the olefin copolymer used has a mass-average molecular weight of less than 5,000, could not be said to have a long fatigue life, and also the lubricating oil compositions of Comparative Examples 3 to 5, in which a polyalkyl methacrylate was used in place of olefin copolymer, could not be said to have a long fatigue life. The lubricating oil compositions of Comparative Examples could not be said to have a long fatigue life and a low viscosity.

The invention claimed is:

1. A lubricating oil composition for transmissions comprising a base oil and an olefin copolymer, wherein the mass-average molecular weight of the olefin copolymer is 5,000 or more and 30,000 or less, the hydrodynamic radius of the olefin copolymer is 1.00 nm or more and 5.00 nm or less, and the content of the olefin copolymer based on the total amount of the composition is 1.0% by mass or more and 8.0% by mass or less.

2. The lubricating oil composition for transmissions according to claim 1, satisfying the following numerical formula (1):

$$25.00 \leq -23.00 \times Rh^2 + 139.00 \times Rh + 4.75 \times C - 179.88 \quad (1)$$

wherein:

Rh is a hydrodynamic radius of the olefin copolymer (nm),

C is a content of the olefin copolymer based on the total amount of the composition (% by mass).

3. The lubricating oil composition for transmissions according to claim 1, wherein the hydrodynamic radius of the olefin copolymer is 2.00 nm or more and 4.00 nm or less.

4. The lubricating oil composition for transmissions according to claim 1, wherein the 100° C. kinematic viscosity of the base oil is 1.0 $mm^2/s$ or more and 15.0 $mm^2/s$ or less.

5. The lubricating oil composition for transmissions according to claim 1, wherein the base oil is a mineral oil.

6. The lubricating oil composition for transmissions according to claim 1, having a 100° C. kinematic viscosity of 10.0 $mm^2/s$ or less.

7. The lubricating oil composition for transmissions according to claim 1, which is for automatic transmissions or continuously variable transmissions.

8. A lubricating method using a lubricating oil composition for transmissions of claim 1.

9. The lubricating oil composition for transmissions according to claim 1, wherein the 100° C. kinematic viscosity of the olefin copolymer of 2.1 $mm^2/s$ or more and 2.8 mm2/s or less.

10. A method for producing a lubricating oil composition for transmissions, comprising blending a base oil and an olefin copolymer having a mass-average molecular weight of 5,000 or more and 30,000 or less and having a hydrodynamic radius (Rh) of 1.00 nm or more and 5.00 nm or less, in such a manner that the content (C) of the olefin copolymer based on the total amount of the composition can be 1.0% by mass or more and 8.0% by mass or less.

11. The method for producing a lubricating oil composition for transmissions according to claim 8, wherein the components are blended so as to satisfy the following numerical formula (1):

$$25.00 \leq -23.00 \times Rh^2 + 139.00 \times Rh + 4.75 \times C - 179.88 \quad (1)$$

wherein:

Rh is a hydrodynamic radius of the olefin copolymer (nm),

C is a content of the olefin copolymer based on the total amount of the composition (% by mass).

* * * * *